US010188567B2

(12) United States Patent
Wurdeman

(10) Patent No.: US 10,188,567 B2
(45) Date of Patent: Jan. 29, 2019

(54) HOSPITAL CHAIR BEDS WITH EXTENDABLE/RETRACTABLE FOOT SECTIONS

(71) Applicant: Byron Wade Wurdeman, Dobson, NC (US)

(72) Inventor: Byron Wade Wurdeman, Dobson, NC (US)

( * ) Notice: Subject to any disclaimer, the term of this patent is extended or adjusted under 35 U.S.C. 154(b) by 585 days.

(21) Appl. No.: 14/925,537

(22) Filed: Oct. 28, 2015

(65) Prior Publication Data

US 2016/0120717 A1 May 5, 2016

Related U.S. Application Data

(60) Provisional application No. 62/072,461, filed on Oct. 30, 2014, provisional application No. 62/158,768, filed on May 8, 2015.

(51) Int. Cl.

| | |
|---|---|
| ***A61G 7/015*** | (2006.01) |
| ***A61G 7/012*** | (2006.01) |
| ***A61G 7/16*** | (2006.01) |

(52) U.S. Cl.

CPC ..... *A61G 7/015* (2013.01); *A61G 7/012* (2013.01); *A61G 7/16* (2013.01)

(58) Field of Classification Search

CPC ..... A61G 7/015; A61G 7/005; A61G 7/012; A61G 7/05; A61G 7/0506; A61G 7/16

See application file for complete search history.

(56) References Cited

U.S. PATENT DOCUMENTS

| | | | |
|---|---|---|---|
| RE10,906 | E | 3/1888 | Case |
| 487,625 | A | 12/1892 | Kales |

(Continued)

FOREIGN PATENT DOCUMENTS

| | | | |
|---|---|---|---|
| EP | 0 596 115 | A1 | 5/1992 |
| GB | 1 259 181 | A | 1/1972 |

(Continued)

OTHER PUBLICATIONS

Communication pursuant to Article 94(3) EPC, EP 09 788 887.9, dated Aug. 23, 2013, 8 pages.

(Continued)

*Primary Examiner* — Eric J Kurilla

(74) *Attorney, Agent, or Firm* — Myers Bigel, P.A.

(57) ABSTRACT

A hospital bed includes a base, a lifting mechanism, a rotating frame configured to rotate horizontally relative to the base, and a patient support surface pivotally secured to the rotating frame. The patient support surface includes a back section, a seat section, and foot section that articulate relative to each other. The patient support surface translates from a bed configuration to a side-egress chair or stand assist configuration. The foot section includes a plurality of panels configured to move relative to each other in substantially parallel overlapping planes between an extended configuration and a retracted configuration when the patient support surface is in a chair or stand assist configuration. The foot section contacts a floor which causes the plurality of panels to move to the retracted configuration. Biasing members urge the plurality of panels to the extended configuration when the foot section no longer contacts the floor.

15 Claims, 11 Drawing Sheets

(56) References Cited

U.S. PATENT DOCUMENTS 488,649 A 12/1892 Daggett
712,671 A 11/1902 Haller
890,407 A 6/1908 Colles
924,626 A 6/1909 Arnold
2,042,399 A 5/1936 Holme
RE21,972 E 12/1941 Demcak
2,283,549 A 5/1942 Galbraith
2,452,366 A 10/1948 Freund
2,475,003 A 7/1949 Black
2,682,913 A 7/1954 Manternach
3,053,568 A 9/1962 Miller
3,210,779 A 10/1965 Herbold
3,215,469 A 11/1965 Wamsley
3,233,255 A 2/1966 Propst
3,237,212 A 3/1966 Hillenbrand et al.
3,336,606 A 8/1967 Beitzel
3,754,749 A * 8/1973 Lyon ..... A61G 13/009 5/616
4,227,269 A 10/1980 Johnston
4,411,035 A 10/1983 Fenwick
4,551,872 A 11/1985 Reed
4,613,997 A 9/1986 Langdale
4,638,519 A 1/1987 Hess
4,648,389 A 3/1987 Kowalski et al.
4,669,136 A 6/1987 Waters et al.
4,724,555 A * 2/1988 Poehner ..... A61G 7/0506 5/183
4,847,929 A 7/1989 Pupovic
4,858,260 A 8/1989 Failor et al.
4,862,529 A 9/1989 Peck
4,899,403 A 2/1990 Yamasaki
4,926,457 A 5/1990 Poehner et al.
5,024,486 A 6/1991 Auel
5,033,793 A 7/1991 Quintile
5,060,636 A 10/1991 Bell
5,072,463 A 12/1991 Willis
5,133,097 A 7/1992 Pyles
5,138,729 A 8/1992 Ferrand
5,230,113 A 7/1993 Foster et al.
5,265,935 A 11/1993 Geisler et al.
5,279,010 A 1/1994 Ferrand et al.
5,369,825 A 12/1994 Reesby
5,377,370 A 1/1995 Foster et al.
5,454,126 A 10/1995 Foster et al.
5,469,588 A * 11/1995 DiMatteo ..... A61G 7/005 5/184
5,479,666 A 1/1996 Foster et al.
5,497,518 A 3/1996 Iura
5,537,701 A 7/1996 Elliott
5,564,438 A 10/1996 Merchant
5,715,548 A 2/1998 Weismiller et al.
5,778,467 A 7/1998 Scott et al.
5,784,734 A 7/1998 Scott et al.
5,791,001 A 8/1998 Wang
5,794,286 A 8/1998 Scott et al.
5,906,016 A 5/1999 Ferrand et al.
5,906,017 A 5/1999 Ferrand et al.
6,076,208 A 6/2000 Heimbrock et al.
6,182,316 B1 2/2001 Thomas et al.
6,202,230 B1 3/2001 Borders
6,202,231 B1 3/2001 Heimbrock et al.
6,212,714 B1 * 4/2001 Allen ..... A61G 7/00 5/184
6,272,702 B1 8/2001 Uchida et al.
6,315,319 B1 11/2001 Hanson et al.
6,427,264 B1 8/2002 Metz et al.
6,446,287 B2 9/2002 Borders
6,496,993 B2 12/2002 Allen et al.
6,565,112 B2 5/2003 Hanson et al.
6,578,219 B1 6/2003 Gabel et al.
6,584,629 B2 7/2003 Tsuji et al.
6,611,979 B2 * 9/2003 Welling ..... A61G 7/0528 5/624
6,658,680 B2 12/2003 Osborne et al.
6,684,427 B2 2/2004 Allen et al.
6,694,548 B2 2/2004 Foster et al.
6,704,954 B2 3/2004 Metz et al.
6,726,279 B1 4/2004 Figel et al.
6,766,547 B1 7/2004 Lagassey
6,792,633 B1 9/2004 Ito
6,862,762 B1 3/2005 Johnson et al.
6,880,189 B2 4/2005 Welling et al.
6,910,236 B2 * 6/2005 Rene ..... A47C 17/163 5/184
6,912,749 B2 7/2005 Thomas et al.
6,957,461 B2 10/2005 Osborne et al.
6,983,499 B2 1/2006 Gladney
7,000,272 B2 2/2006 Allen et al.
7,017,208 B2 3/2006 Weismiller et al.
7,086,103 B2 8/2006 Barthelt
7,107,636 B2 9/2006 Metz et al.
7,171,708 B2 2/2007 Osborne et al.
7,171,709 B2 2/2007 Weismiller
7,216,384 B2 5/2007 Allen et al.
7,228,579 B2 6/2007 Tidwell
7,234,178 B2 6/2007 Qi
7,287,289 B1 10/2007 Hagopian
7,458,119 B2 12/2008 Hornbach et al.
7,523,515 B2 4/2009 Allen et al.
7,788,748 B2 9/2010 Wurdeman
RE43,155 E * 2/2012 Allen ..... A61G 7/00 5/618
8,332,977 B2 12/2012 Bochner et al.
8,375,489 B2 2/2013 Manouchehri
8,495,774 B2 7/2013 Soltani
8,887,329 B2 11/2014 Soltani
9,687,401 B2 * 6/2017 Alford ..... A63B 71/0619
2001/0000363 A1 4/2001 Borders
2001/0029628 A1 10/2001 Ferrand et al.
2002/0002742 A1 1/2002 Osborne et al.
2002/0066142 A1 6/2002 Osborne et al.
2002/0170113 A1 11/2002 Metz et al.
2002/0170115 A1 11/2002 Borders et al.
2002/0170116 A1 11/2002 Borders et al.
2002/0178502 A1 * 12/2002 Beasley ..... A61G 7/015 5/618
2003/0061661 A1 4/2003 Borders et al.
2003/0088920 A1 5/2003 Allen et al.
2003/0093860 A1 5/2003 Kramer et al.
2003/0093863 A1 5/2003 Grove
2004/0034931 A1 2/2004 Kummer et al.
2004/0172753 A1 9/2004 Metz et al.
2004/0177445 A1 * 9/2004 Osborne ..... A61G 7/0528 5/600
2004/0205895 A1 10/2004 Ito
2004/0231052 A1 11/2004 Gladney
2004/0231056 A1 11/2004 Jansen
2005/0138731 A1 6/2005 Failor et al.
2005/0144724 A1 7/2005 Petric
2005/0172405 A1 * 8/2005 Menkedick ..... A61B 5/1115 5/618
2006/0000022 A1 1/2006 Dewert
2006/0006724 A1 1/2006 Shimizu
2006/0021142 A1 2/2006 Hornbach et al.
2006/0026762 A1 2/2006 Hornbach et al.
2006/0075560 A1 4/2006 Osborne et al.
2006/0085914 A1 4/2006 Peterson et al.
2006/0096029 A1 5/2006 Osborne et al.
2006/0150332 A1 7/2006 Weismiller et al.
2006/0162079 A1 7/2006 Menkedick et al.
2006/0168728 A1 8/2006 Strobel et al.
2006/0168729 A1 8/2006 Weismiller et al.
2006/0168730 A1 8/2006 Menkedick et al.
2006/0168731 A1 8/2006 Menkedick et al.
2006/0191073 A1 8/2006 Honda
2006/0236458 A1 10/2006 Bartheit
2006/0253982 A1 11/2006 Kummer et al.
2007/0017029 A1 * 1/2007 Wurdeman ..... A61G 7/00 5/618
2007/0089238 A1 4/2007 Kramer et al.
2007/0136949 A1 * 6/2007 Richards ..... A61G 7/05 5/600
2007/0157385 A1 7/2007 Lemire et al.

(56) References Cited

U.S. PATENT DOCUMENTS

| | | | | |
|---|---|---|---|---|
| 2007/0169267 | A1* | 7/2007 | Paz | A61G 7/015 5/610 |
| 2007/0169268 | A1 | 7/2007 | Lemire et al. | |
| 2007/0174964 | A1 | 8/2007 | Lemire et al. | |
| 2007/0174965 | A1 | 8/2007 | Lemire et al. | |
| 2007/0174967 | A1 | 8/2007 | Bourgraf et al. | |
| 2007/0174968 | A1* | 8/2007 | Barthelt | A47C 19/045 5/618 |
| 2007/0180618 | A1 | 8/2007 | Weismiller et al. | |
| 2007/0180626 | A1 | 8/2007 | Ellis et al. | |
| 2007/0289064 | A1 | 12/2007 | Martin et al. | |
| 2008/0010748 | A1 | 1/2008 | Menkedick et al. | |
| 2008/0052831 | A1 | 3/2008 | Weismiller et al. | |
| 2008/0092292 | A1 | 4/2008 | Rawls-Meehan | |
| 2008/0092293 | A1 | 4/2008 | Rawls-Meehan | |
| 2008/0092294 | A1 | 4/2008 | Rawls-Meehan | |
| 2008/0109959 | A1 | 5/2008 | Rawls-Meehan | |
| 2008/0115272 | A1 | 5/2008 | Rawls-Meehan | |
| 2008/0115273 | A1 | 5/2008 | Rawls-Meehan | |
| 2008/0115274 | A1 | 5/2008 | Rawls-Meehan | |
| 2008/0115275 | A1 | 5/2008 | Rawls-Meehan | |
| 2008/0115276 | A1 | 5/2008 | Rawls-Meehan | |
| 2008/0115277 | A1 | 5/2008 | Rawls-Meehan | |
| 2008/0115278 | A1 | 5/2008 | Rawls-Meehan | |
| 2008/0115279 | A1 | 5/2008 | Rawls-Meehan | |
| 2008/0115280 | A1 | 5/2008 | Rawls-Meehan | |
| 2008/0115281 | A1 | 5/2008 | Rawls-Meehan | |
| 2008/0115282 | A1 | 5/2008 | Rawls-Meehan | |
| 2012/0117732 | A1* | 5/2012 | O'Keefe | A61G 7/002 5/613 |
| 2012/0198628 | A1* | 8/2012 | Richards | A61G 7/012 5/618 |
| 2013/0007960 | A1 | 1/2013 | Manouchehri et al. | |

FOREIGN PATENT DOCUMENTS

| | | | |
|---|---|---|---|
| GB | 2 223 936 | A | 4/1990 |
| JP | 08-308886 | A | 11/1996 |
| JP | 09-010264 | A | 1/1997 |
| KR | 10-0621350 | B1 | 8/2006 |
| WO | WO 2007/146467 | A1 | 12/2007 |

OTHER PUBLICATIONS

Med Mizer®: PIVOT-REHAB 1000™; Brochure—4 pages; http://www.med-mizer.com/wp-content/uploads/2011-03-Med-MizerPR1000.pdf.

Notification of Transmittal of the International Search Report and the Written Opinion of the International Searching Authority issued by the Korean Intellectual Property Office dated Mar. 31, 2010 for corresponding PCT Application No. PCT/US2009/056681.

Notification of Transmittal of the International Search Report and the Written Opinion of the International Searching Authority issued by the European Patent Office dated Oct. 23, 2009 for the corresponding PCT Application No. PCT/US2009/004010.

* cited by examiner

HOSPITAL CHAIR BEDS WITH EXTENDABLE/RETRACTABLE FOOT SECTIONS

RELATED APPLICATIONS

This application claims the benefit of and priority to U.S. Provisional Patent Application No. 62/072,461 filed Oct. 30, 2014, and U.S. Provisional Patent Application No. 62/158,768 filed May 8, 2015, the disclosures of which are incorporated herein by reference as if set forth in their entireties.

FIELD OF THE INVENTION

The present invention relates generally to the field of hospital beds and, more specifically, to hospital beds that are convertible into a chair configuration.

BACKGROUND

Conventional hospital beds are configured to provide a sufficiently comfortable support surface for patients in a supine position. In many cases, it is desirable for patients to elevate from a supine position to a sitting position in order to increase the activity of the circulatory and cardiovascular systems and/or in the course of medical treatment. In addition, patients may be interested in sitting up in bed to be more comfortable, for example, in order to read or meet with visitors. However, it may be difficult for some patients to get out of a hospital bed. As such, hospital beds that can be converted into chair-like configurations have been developed. In addition, hospital beds that can assist patients in moving from a supine position to a sitting position for the purpose of achieving a standing or walking position have also been developed.

SUMMARY

According to some embodiments of the present invention, a hospital bed that can be converted to a chair configuration includes a base having opposite end portions, a lifting mechanism secured to the base between the end portions, and a patient support surface pivotally secured to the lifting mechanism. The patient support surface is configured to support a mattress thereon. The lifting mechanism is configured to raise the patient support surface and mattress relative to the base to a stand-assist configuration to facilitate egress by a patient. A rotating frame is mounted on the lifting mechanism and is configured to rotate horizontally relative to the base. The patient support surface is pivotally secured to the rotating frame and the patient support surface is configured to translate from a bed configuration to a side-egress chair configuration.

The patient support surface can include a back section, a seat section, and a foot section that are configured to articulate relative to each other. The patient support surface can be configured to translate from a bed configuration to a chair or stand assist configuration. The foot section includes a plurality of panels that are configured to move relative to each other in substantially parallel overlapping planes between an extended configuration and a retracted configuration. The foot section is configured to engage a floor surface when the patient support surface is in a chair configuration, and the engagement with the floor surface causes the plurality of panels to move to the retracted configuration. The foot section can include one or more biasing members, such as springs, that are configured to urge the plurality of panels to the extended configuration when the foot section is not engaged with the floor surface.

In some embodiments of the present invention, the foot section includes first, second, third, fourth, and fifth panels operably connected together. The first, third and fifth panels move relative to each other in a first one of the planes, and the second and fourth panels move relative to each other in a second one of the planes. The foot section includes a frame assembly that has a base with opposite first and second sides. A first section is telescopically secured to the base first side and is movable relative to the base between retracted and extended positions. A second section is telescopically secured to the base second side and is movable relative to the base between retracted and extended positions. The base includes one or more biasing members that are configured to urge the first and second sections of the frame assembly outwardly from the base to respective extended positions.

In some embodiments, the frame assembly first and second sections each include a plurality of spaced-apart elongated legs that are telescopically secured to the base. The base includes a respective plurality of biasing members associated with the first section legs that are configured to urge the first section outwardly from the base to a respective extended position. The base also includes a respective plurality of biasing members associated with the second section legs that are configured to urge the second section outwardly from the base to a respective extended position.

The first panel can be secured to the frame assembly first section, the third panel can be secured to the frame assembly base, and the fifth panel can be secured to the frame assembly second section. The second panel can be slidably secured to the first and third panels, and the fourth panel can be slidably secured to the third and fifth panels.

The frame assembly second section can be pivotally secured to the seat section and an actuator is configured to move the foot section between a substantially co-planar configuration relative to the seat section and a substantially orthogonal configuration relative to the seat section.

In some embodiments, the frame assembly first section includes at least one rolling member or wheel that is configured to contact the floor surface and roll along the floor surface as the foot section is moved to a substantially orthogonal configuration relative to the seat section.

According to other embodiments of the present invention, a method of translating a hospital bed to an egress configuration includes articulating back, seat and foot sections of a patient support surface relative to each other from a substantially co-planar configuration to a chair configuration. The foot section includes a plurality of panels that are configured to move relative to each other in substantially parallel overlapping planes between an extended configuration when the patient support surface is in a bed configuration and a retracted configuration when the patient support surface is in a chair configuration. The foot section contacts a floor surface to cause the plurality of panels to move to the retracted configuration.

In some embodiments, the foot section includes first, second, third, fourth, and fifth panels operably connected together. Contacting the floor surface with the foot section causes the first, third and fifth panels to move relative to each other in a first one of the planes, and causes the second and fourth panels to move relative to each other in a second one of the planes. In some embodiments, the back, seat and foot sections are rotated 90 degrees to a side egress position prior to contacting the floor surface with the foot section.

In some embodiments, some of the foot section panels include one or more mattress support members. As the foot section panels are moved to a retracted configuration, the mattress support members move closer together thereby causing a portion of a mattress secured thereto to move to a retracted configuration.

It is noted that aspects of the invention described with respect to one embodiment, may be incorporated in a different embodiment although not specifically described relative thereto. That is, all embodiments and/or features of any embodiment can be combined in any way and/or combination. These and other objects and/or aspects of the present invention are explained in detail in the specification set forth below.

BRIEF DESCRIPTION OF THE DRAWINGS

The accompanying drawings, which form a part of the specification, illustrate embodiments of the present invention. The drawings and description together serve to fully explain the invention.

DETAILED DESCRIPTION

Figure 1:
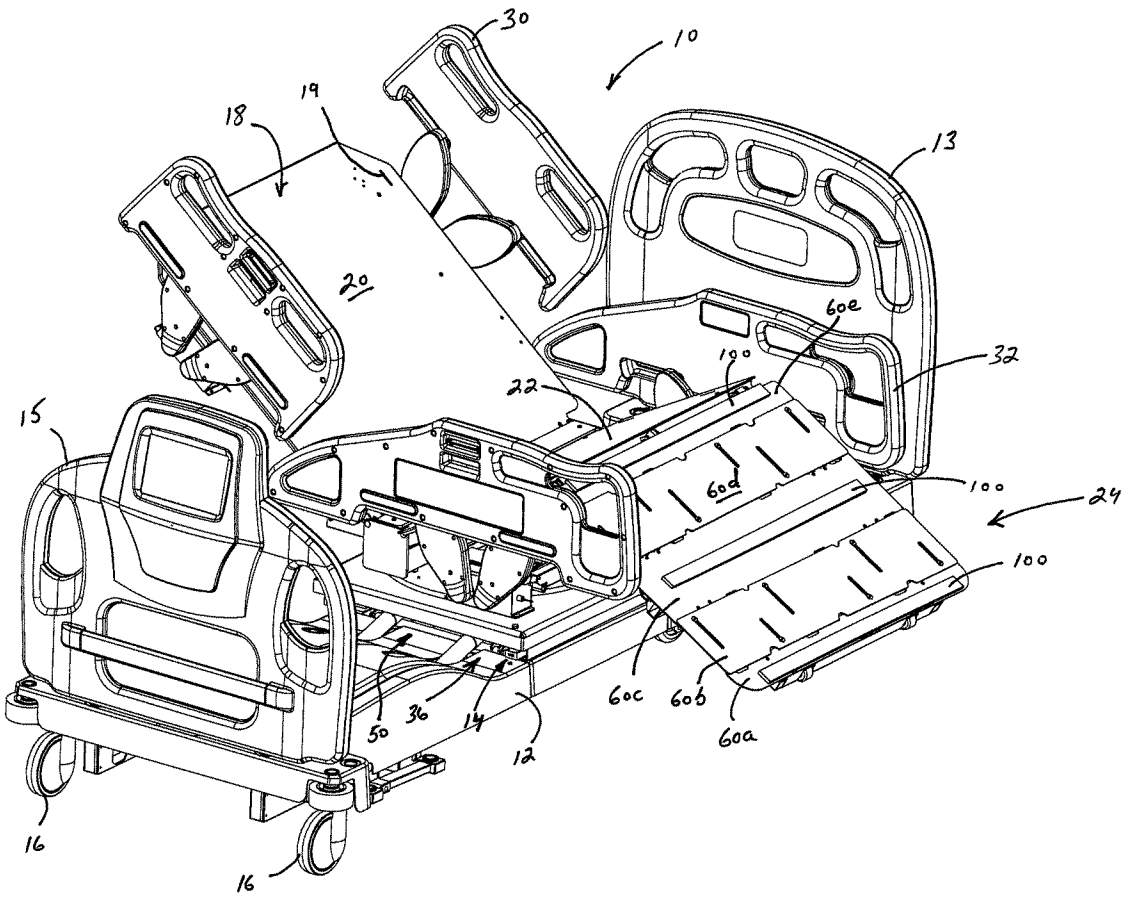
FIG. 1 is a top perspective view of a hospital chair bed in a chair configuration (side egress) and having an extendable/retractable foot section, shown in an extended configuration, according to some embodiments of the present invention.

The present invention will now be described more fully hereinafter with reference to the accompanying figures, in which embodiments of the invention are shown. This invention may, however, be embodied in many different forms and should not be construed as limited to the embodiments set forth herein. Like numbers refer to like elements throughout. In the figures, certain components or features may be exaggerated for clarity, and broken lines may illustrate optional features or elements unless specified otherwise. In addition, the sequence of operations (or steps) is not limited to the order presented in the figures and/or claims unless specifically indicated otherwise. Features described with respect to one figure or embodiment can be associated with another embodiment or figure although not specifically described or shown as such.

It will be understood that when a feature or element is referred to as being "on" another feature or element, it can be directly on the other feature or element or intervening features and/or elements may also be present. In contrast, when a feature or element is referred to as being "directly on" another feature or element, there are no intervening features or elements present. It will also be understood that, when a feature or element is referred to as being "connected", "attached" or "coupled" to another feature or element, it can be directly connected, attached or coupled to the other feature or element or intervening features or elements may be present. In contrast, when a feature or element is referred to as being "directly connected", "directly attached" or "directly coupled" to another feature or element, there are no intervening features or elements present. Although described or shown with respect to one embodiment, the features and elements so described or shown can apply to other embodiments.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof. As used herein, the term "and/or" includes any and all combinations of one or more of the associated listed items and may be abbreviated as "/".

As used herein, phrases such as "between X and Y" and "between about X and Y" should be interpreted to include X and Y. As used herein, phrases such as "between about X and Y" mean "between about X and about Y." As used herein, phrases such as "from about X to Y" mean "from about X to about Y."

Spatially relative terms, such as "under", "below", "lower", "over", "upper" and the like, may be used herein for ease of description to describe one element or feature's relationship to another element(s) or feature(s) as illustrated in the figures. It will be understood that the spatially relative terms are intended to encompass different orientations of a device in use or operation in addition to the orientation depicted in the figures. For example, if a device in the figures is inverted, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly. Similarly, the terms "upwardly", "downwardly", "vertical", "horizontal" and the like are used herein for the purpose of explanation only unless specifically indicated otherwise.

It will be understood that although the terms first and second are used herein to describe various features or elements, these features or elements should not be limited by these terms. These terms are only used to distinguish one feature or element from another feature or element. Thus, a first feature or element discussed below could be termed a second feature or element, and similarly, a second feature or element discussed below could be termed a first feature or element without departing from the teachings of the present invention.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the specification and relevant art and should not be interpreted in an idealized or overly formal sense unless expressly so defined herein. Well-known functions or constructions may not be described in detail for brevity and/or clarity.

The term "about", as used herein with respect to a value or number, means that the value or number can vary more or less, for example by +/−20%, +/−10%, +/−5%, +/−1%, +/−0.5%, +/−0.1%, etc.

As used herein, the terms "comprise", "comprising", "comprises", "include", "including", "includes", "have", "has", "having", or variants thereof are open-ended, and include one or more stated features, integers, elements, steps, components or functions but does not preclude the presence or addition of one or more other features, integers, elements, steps, components, functions or groups thereof. Furthermore, as used herein, the common abbreviation "e.g.", which derives from the Latin phrase "exempli gratia," may be used to introduce or specify a general example or examples of a previously mentioned item, and is not intended to be limiting of such item. The common abbreviation "i.e.", which derives from the Latin phrase "id est," may be used to specify a particular item from a more general recitation.

Figure 2:
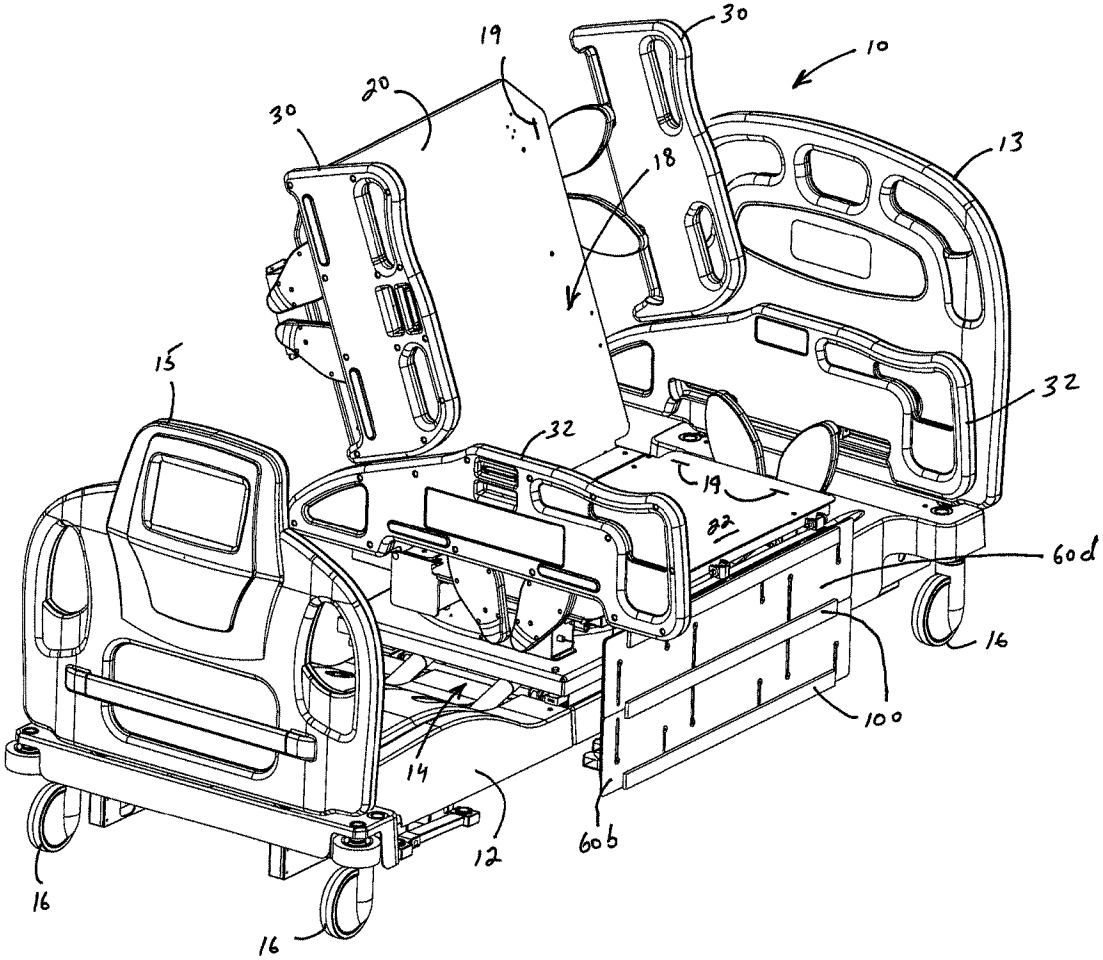
FIG. 2 is a top perspective view of the hospital chair bed of FIG. 1 with the extendable/retractable foot section shown in a retracted configuration, according to some embodiments of the present invention.

Referring to FIGS. 1-2, a hospital bed 10, according to some embodiments of the present invention, is illustrated. The illustrated bed 10 has a base 12 and a rotating frame 14 mounted on the base 12. The frame 14 is configured to rotate relative to the base 12 to facilitate side egress from the bed 10 by a patient, as will be described below. Casters 16 are mounted to the four corners of the base 12 and facilitate movement of the bed 10 about the hospital or other environment. In some embodiments, casters 16 are locking casters that can be selectively locked to prevent movement of the bed 10.

The illustrated bed 10 has a patient support surface 18 configured to support a mattress M (FIG. 9) on which a patient is situated. A portion of the mattress M may be attached to the patient support surface 18 via a plurality of straps (e.g., nylon webbing straps, etc.) attached to the mattress ticking. The straps extend down through various respective slots 19 formed in the patient support surface 18, and can be fastened via connectors under the patient support surface 18. Exemplary connectors are "D" rings. However, various types of connectors and various ways of securing a mattress to the patient support surface 18 can be utilized, without limitation. As will be described below, a portion of the mattress M overlying the foot section 2 can be secured to the patient support surface 18 via mattress support members secured to panels of the foot section 24.

The patient support surface 18 is supported by the rotating frame 14 and includes a back section 20, a seat section 22, and a foot section 24. The back section 20, seat section 22 and foot section 24 can articulate with respect to each other and can be serially hinged or otherwise movably secured together, as illustrated. The back section 20 and seat section 22 can be pivotally attached to each other by pins, hinges, or other suitable mechanisms well known in the art. The seat section 22 and foot section 24 can also be pivotally attached to each other by pins, hinges, or other suitable mechanisms well known in the art.

In some embodiments, hospital bed 10 may have a patient support surface 18 that can be articulated into a chair configuration without rotating to a side egress position. For example, the patient support surface 18 articulates as described herein to a chair or stand assist configuration such that a patient can egress from the foot of the bed 10.

A mattress M (FIG. 9) supported by the patient support surface 18 may have a foot section 24 that can retract when the hospital chair bed 10 is moved from a bed configuration to a chair or stand assist configuration and the foot section 24 moves to a retracted configuration as described below. Various types of retractable mattress foot sections are described in U.S. Pat. No. 8,495,774, which is incorporated herein by reference in its entirety. The mattress foot section can be attached to the foot section 24 of the bed via mattress support members 100 (FIGS. 1, 2, 9, 10A-10B), as described below.

Still referring to FIGS. 1-2, the illustrated bed 10 also has a first set of patient side rails 30 typically secured to the back section 20 in spaced-apart relationship and a second set of patient side rails 32 typically secured to the seat section 22 and/or foot section 24 in spaced-apart relationship, as illustrated. A head board 13 is secured to the base 12 at the head end of the bed 10 and a foot board 15 is secured to the base 12 at the foot end of the bed 10, as would be understood by those skilled in the art.

The patient support surface 18 can be secured to the rotating frame 14 in various ways, for example via one or more of a transverse rod or pin connection 36 to facilitate tilting of the patient support surface 18 relative to the rotating frame 14. The rotating frame 14 can be secured to the base 12 via a lift mechanism 50, such as a double scissors lift, etc. The lift mechanism 50 is configured to raise and lower the patient support surface 18, via the rotating frame 14, relative to the base 12. The lift mechanism 50 can be driven by hydraulic cylinders, air cylinders, air bags, and/or electrical or electromechanical devices, etc. The lift mechanism 50 can be configured to allow the patient support surface 18 to be raised relatively high relative to the base 12 and to be lowered relatively low with respect to the base 12, as described above. See, e.g., U.S. Pat. No. 7,788,748 for examples of rotational and lift components, which is incorporated herein by reference in its entirety.

The foot section 24 may also be referred to as a "leg" section. Thus, the terms "foot section" and "leg section" are used interchangeably herein. The foot section 24 is pivotally connected to the seat section 22 of the articulating patient support surface 18, for example, via one or more hinges 38 (FIGS. 3-8).

Referring now to FIGS. 3-8, the illustrated foot section 24 includes a plurality of panels 60*a*, 60*b*, 60*c*, 60*d*, 60*e* that are configured to move relative to each other in substantially parallel overlapping planes between an extended configuration (FIGS. 3, 5 and 6) and a retracted configuration (FIGS. 4, 7, 8 and 10B) when the patient support surface 18 is in an egress chair configuration. The panels 60*a*-60*e* are in the retracted configuration in FIGS. 7 and 8 for illustrative purposes although foot section 24 is in a parallel plane to the seat section 22 so that the patient support surface 18 is not in a chair configuration. The foot section 24 is configured to engage a floor surface F (FIG. 4) when the patient support surface 18 is in a chair configuration, and the engagement with the floor surface F causes the plurality of panels 60*a*-60*e* to move to the retracted configuration, as described further below.

The illustrated foot section 24 includes a frame assembly 70 (FIG. 6) that includes a base 72, a first section 74 telescopically secured to one side 72*a* of the base 72 and movable relative to the base 72 between retracted and extended positions, and a second section 76 telescopically secured to the opposite side 72*b* of the base 72 and movable relative to the base 72 between retracted and extended positions. The frame assembly first and second sections 74, 76 are illustrated in their respective extended positions in FIGS. 5 and 6, and are illustrated in their respective retracted positions in FIGS. 7-8.

The illustrated frame assembly first section 74 includes a pair of spaced-apart elongated legs 74*a*, 74*b* that are telescopically secured within respective receiving members 73*a*, 73*b* of the base 72. The receiving members 73*a*, 73*b* can be tubular as shown with a rectangular shape corresponding to the legs 74*a*, 74*b*, but other shapes can be used. Each receiving member 73*a*, 73*b* can include a biasing member 75, such as a spring, that is associated with a respective one of the legs 74*a*, 74*b* and that is configured to urge the frame assembly first section 74 outwardly from the base 72 to an extended position. In the illustrated embodiment, each leg 74*a*, 74*b* includes a guiding slot 74*as*, 74*bs* that is cooperatively engaged with a respective member, such as a rod or pin 73*ap*, 73*bp* in receiving members 73*a*, 73*b*.

The illustrated frame assembly second section 76 includes a pair of spaced-apart elongated legs 76*a*, 76*b* that are telescopically secured within respective receiving members 73*c*, 73*d* of the base 72. The receiving members 73*c*, 73*d* can be tubular as shown with a rectangular shape corresponding to the legs 76*a*, 76*b*, but other shapes can be used. Each receiving member 73*c*, 73*d* can include a biasing member 75, such as a spring, that is associated with a respective one of the legs 76*a*, 7*b* and that is configured to urge the frame assembly second section 76 outwardly from the base 72 to an extended position. In the illustrated embodiment, each leg 76*a*, 76*b* includes a guiding slot 76*as*, 76*bs* that is cooperatively engaged with a respective member, such as a rod or pin 73*cp*, 73*dp* in receiving members 73*c*, 73*d*.

Figure 5:
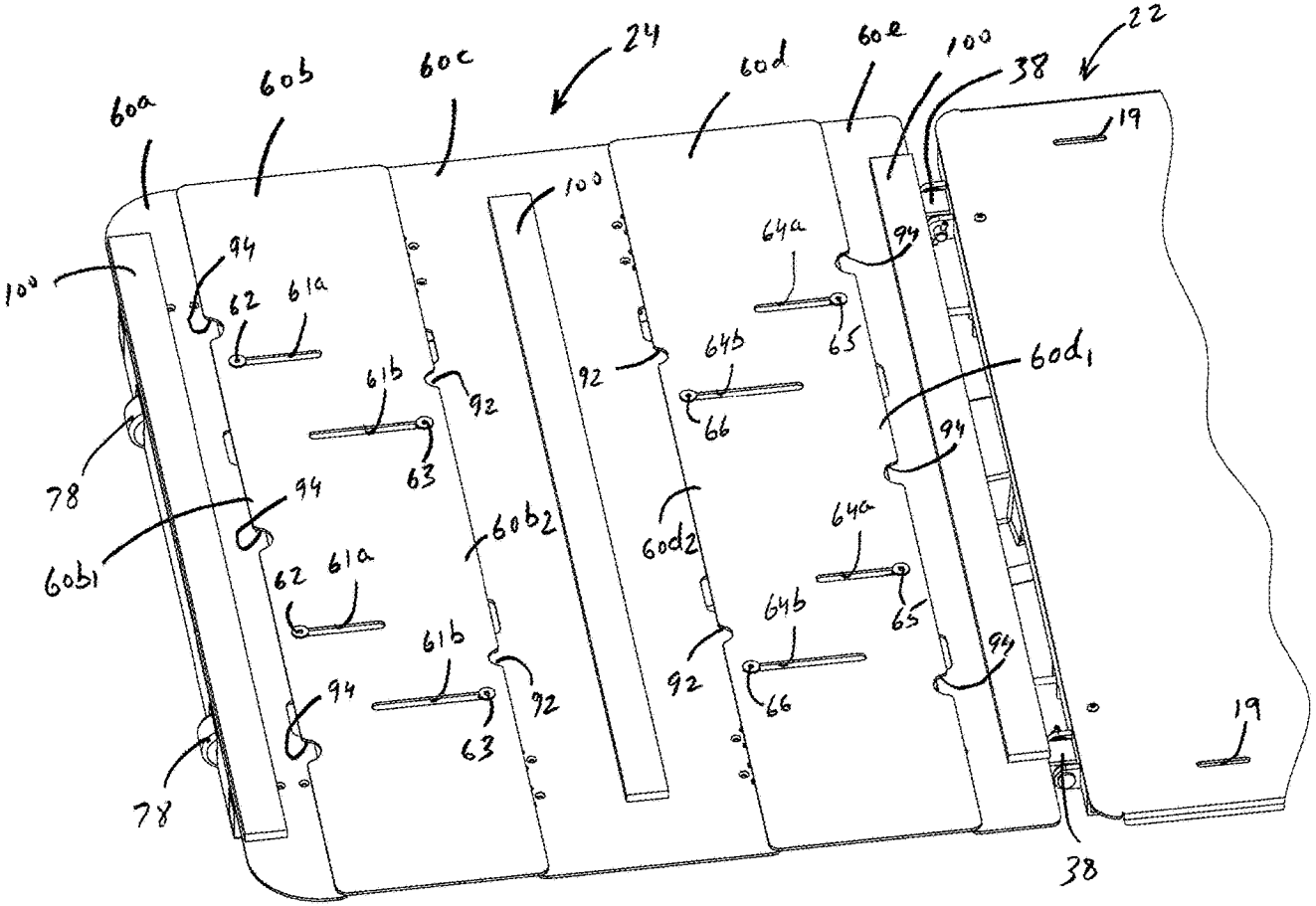
FIG. 5 is a top view of the foot section of the hospital chair bed of FIG. 1 illustrating the foot section in an extended configuration.

The first panel 60*a* is secured to the frame assembly first section 74, the third panel 60*c* is secured to the frame assembly base 72, and the fifth panel 60*e* is secured to the frame assembly second section 76. The second panel 60*b* includes a first set of spaced-apart elongated slots 61*a* adjacent one edge portion $\mathbf{60}b_1$ thereof, and a second set of spaced-apart elongated slots 61*b* adjacent one edge portion $\mathbf{60}b_2$ thereof, as illustrated in FIG. 5. A plurality of pins or rods 62 extend from the first panel 60*a* and each engages a respective one of the slots 61*a*. Similarly, a plurality of pins or rods 63 extend from the third panel 60*c* and each engages a respective one of the slots 61*b*. Rods 62, 63 may be various types of members including pins, screws, bolts, rivets, etc., that allow for panel sliding motion. The term "rod" is used broadly to include various types of mechanical connectors or links, such as pins, bars, plates, etc.

The slots closer to one edge portion of a panel may be longer than slots closer to the opposing edge portion of a respective panel, in some embodiments. In the illustrated embodiment, slots 61*b* are longer than slots 61*a*, and slots 64*b* in panel 60*d* are longer than slots 64*a* in panel 60*d*. In the illustrated embodiment, slots 61*a* and 61*b* are parallel and extend longitudinally, and slots 64*a* and 64*b* are parallel and extend longitudinally.

Figure 7:
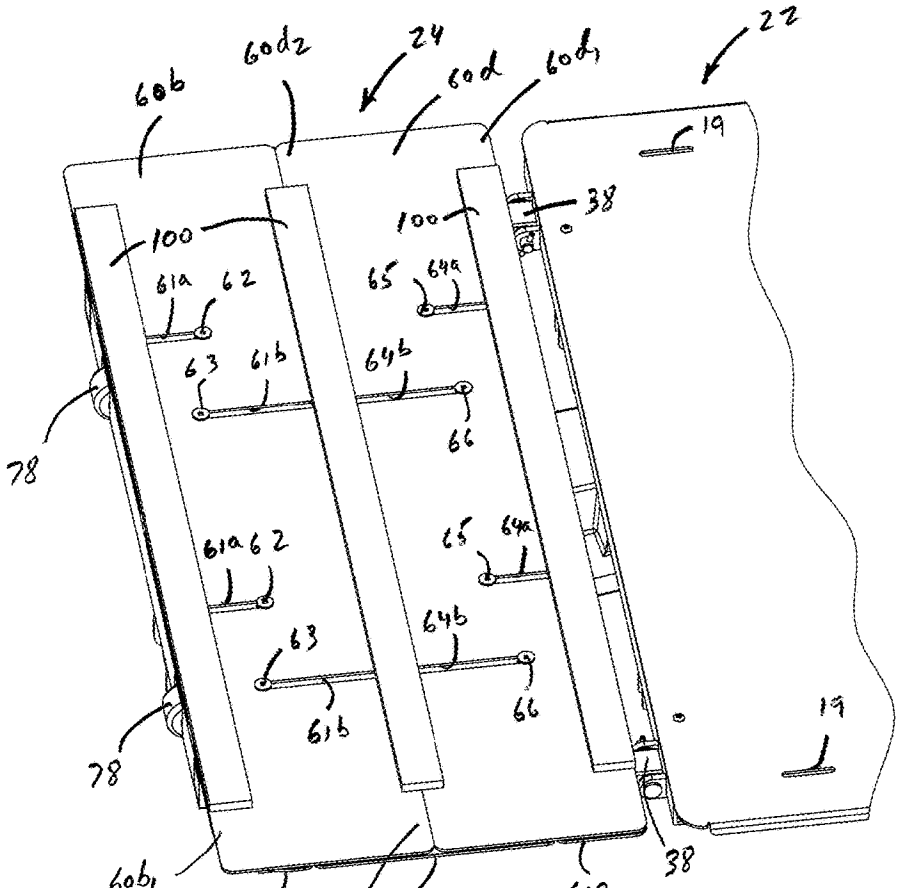
FIG. 7 is a top view of the foot section of the hospital chair bed of FIG. 1 illustrating the foot section in a retracted configuration.
Figure 8:
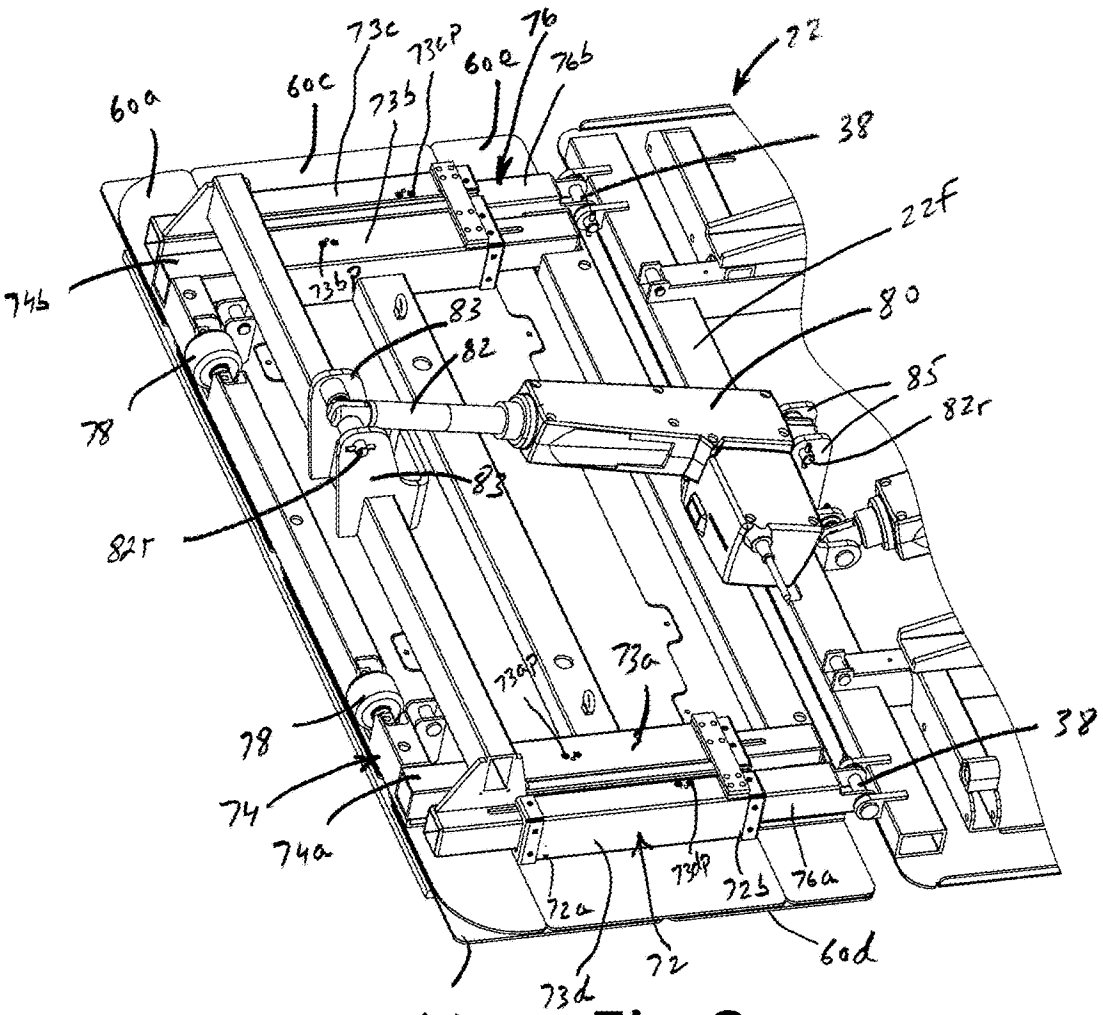
FIG. 8 is a bottom perspective view of the foot section of the hospital chair bed of FIG. 1 illustrating the foot section in a retracted configuration.

This configuration of slots 61*a*, 61*b* and respective rods or pins 62, 63 allows the first and third panels 60*a*, 60*c* to slide towards each other when the frame assembly first section 74 is moved to the retracted position. When the frame assembly first section 74 is moved to the retracted position, as illustrated in FIGS. 7 and 8, the first and third panels 60*a*, 60*c* are in contacting or substantially contacting relationship and the second panel 60*b* overlies the first panel 60*a* and a portion (e.g., between about 20%-90%, such as about 40%, about 50%, about 60%, etc.) of the third panel 60*c*.

The fourth panel 60*d* includes a first set of spaced-apart elongated slots 64*a* adjacent one edge portion $\mathbf{60}d_1$ thereof, and a second set of spaced-apart elongated slots 64*b* adjacent one edge portion $\mathbf{60}d_2$ thereof, as illustrated in FIG. 5. A plurality of pins or rods 65 extend from the fifth panel 60*e* and each engages a respective one of the slots 64*a*. Similarly, a plurality of pins or rods 66 extend from the third panel 60*c* and each engages a respective one of the slots 64*b*. Rods 65, 66 may be various types of members including pins, screws, bolts, rivets, etc., that allow for panel sliding motion. The term "rod" is used broadly to include various types of mechanical connectors or links, such as pins, bars, plates, etc.

This configuration of slots 64*a*, 64*b* and respective rods 65, 66 allows the fifth and third panels 60*e*, 60*c* to slide towards each other when the frame assembly second section 76 is moved to the retracted position. When the frame assembly second section 76 is moved to the retracted position, as illustrated in FIGS. 7 and 8, the fifth and third panels 60*e*, 60*c* are in contacting or substantially contacting relationship and the fourth panel 60*d* overlies the fifth panel 60*e* and a portion (e.g., between about 20%-90%, such as about 40%, 50%, 60%, etc.) of the third panel 60*c*.

In the illustrated embodiment, as the frame assembly first and second sections 74, 76 are moved between extended and retracted positions, the first, third and fifth panels 60*a*, 60*c*, 60*e* move relative to each other in a first plane, and the second and fourth panels 60*b*, 60*d* move relative to each other in a second plane that is substantially parallel with the first plane. When viewed from above the foot section 24 (FIGS. 5 and 7), the second and fourth panels 60*b*, 60*d* move relative to each other in a second plane that overlaps the first plane. When viewed from below the foot section 24 (FIGS. 6 and 8) the first, third and fifth panels 60*a*, 60*c*, 60*e* move relative to each other in the first plane that overlaps the second plane.

Figure 6:
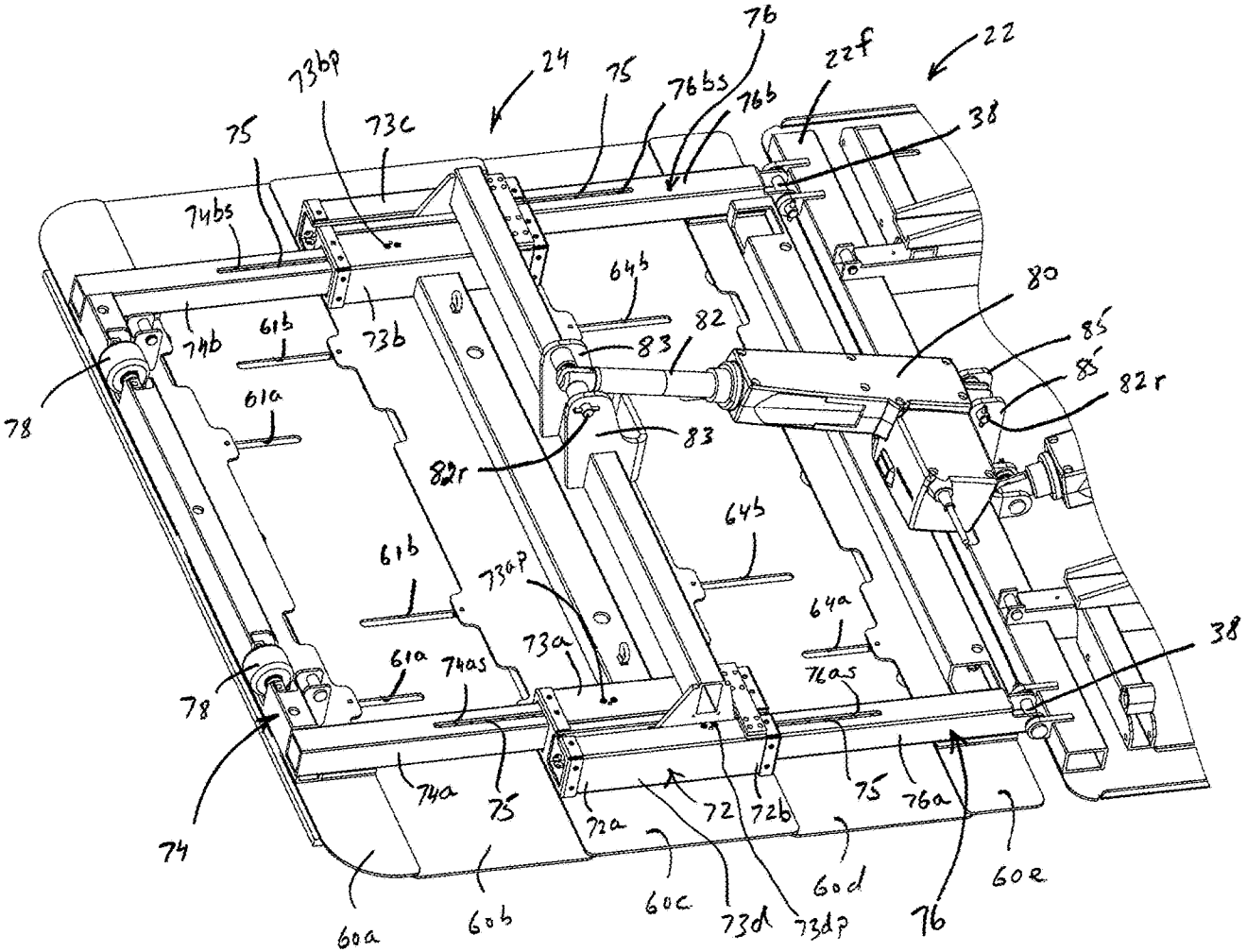
FIG. 6 is a bottom perspective view of the foot section of the hospital chair bed of FIG. 1 illustrating the foot section in an extended configuration.

Referring to FIGS. 6 and 8, an actuator 80 can be utilized to move the foot section 24 between a substantially coplanar configuration relative to the seat section 22 and a substantially orthogonal configuration relative to the seat section 22. The illustrated actuator 80 is secured to a frame 22*f* of the seat section 22 via a bolt or other fastener 82*r* that engages bracket 85 and includes a piston rod 82 that is attached to the frame assembly base 72 via a bolt or other fastener 82*r* that engages bracket 83, as would be understood by one skilled in the art. The actuator 80 may be any of various types of actuators (e.g., an electrical actuator, pneumatic or hydraulic cylinders, or other suitable electromechanical devices, etc.).

Figure 3:
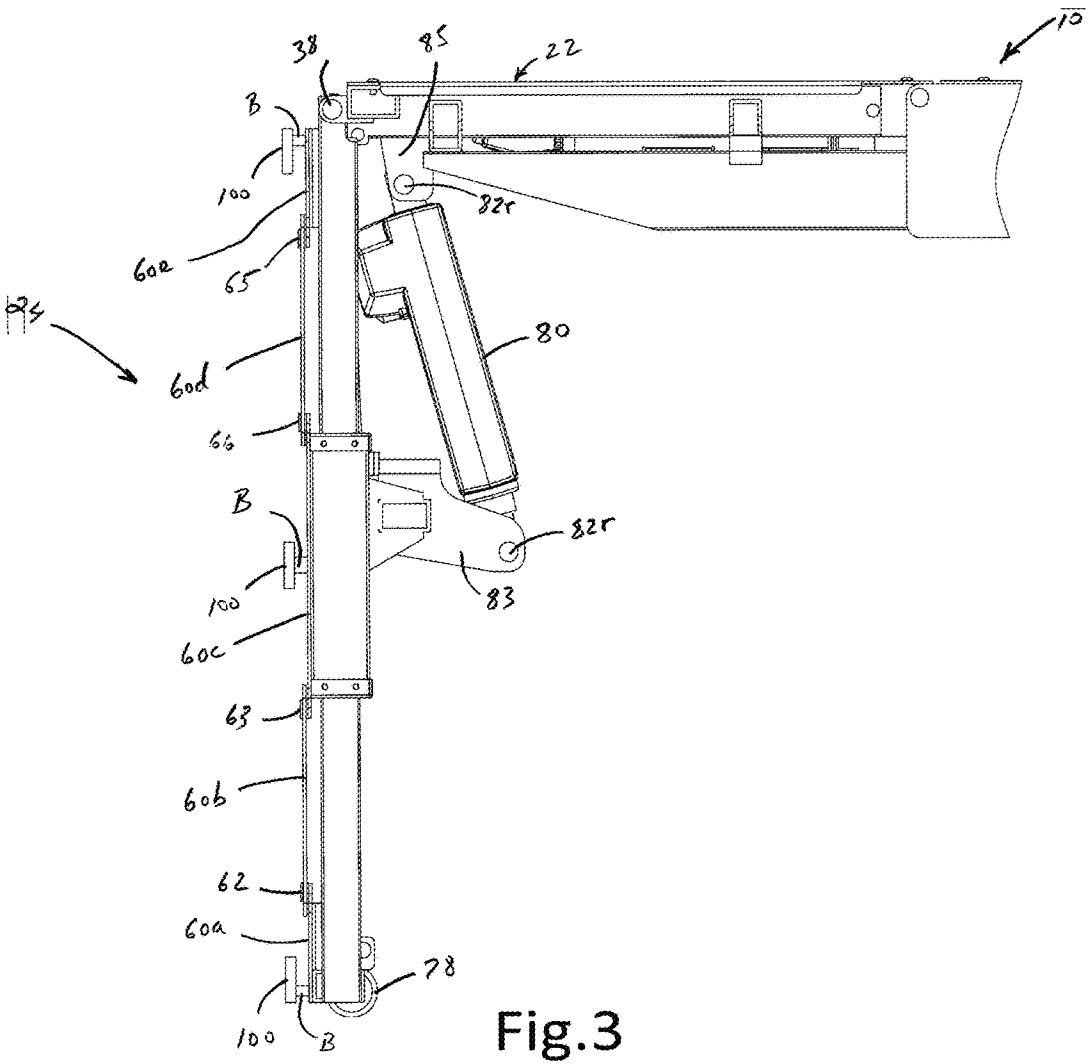
FIG. 3 is a partial side view of the hospital chair bed of FIG. 1 illustrating the hospital chair bed in a chair configuration with the foot section in an extended configuration.
Figure 4:
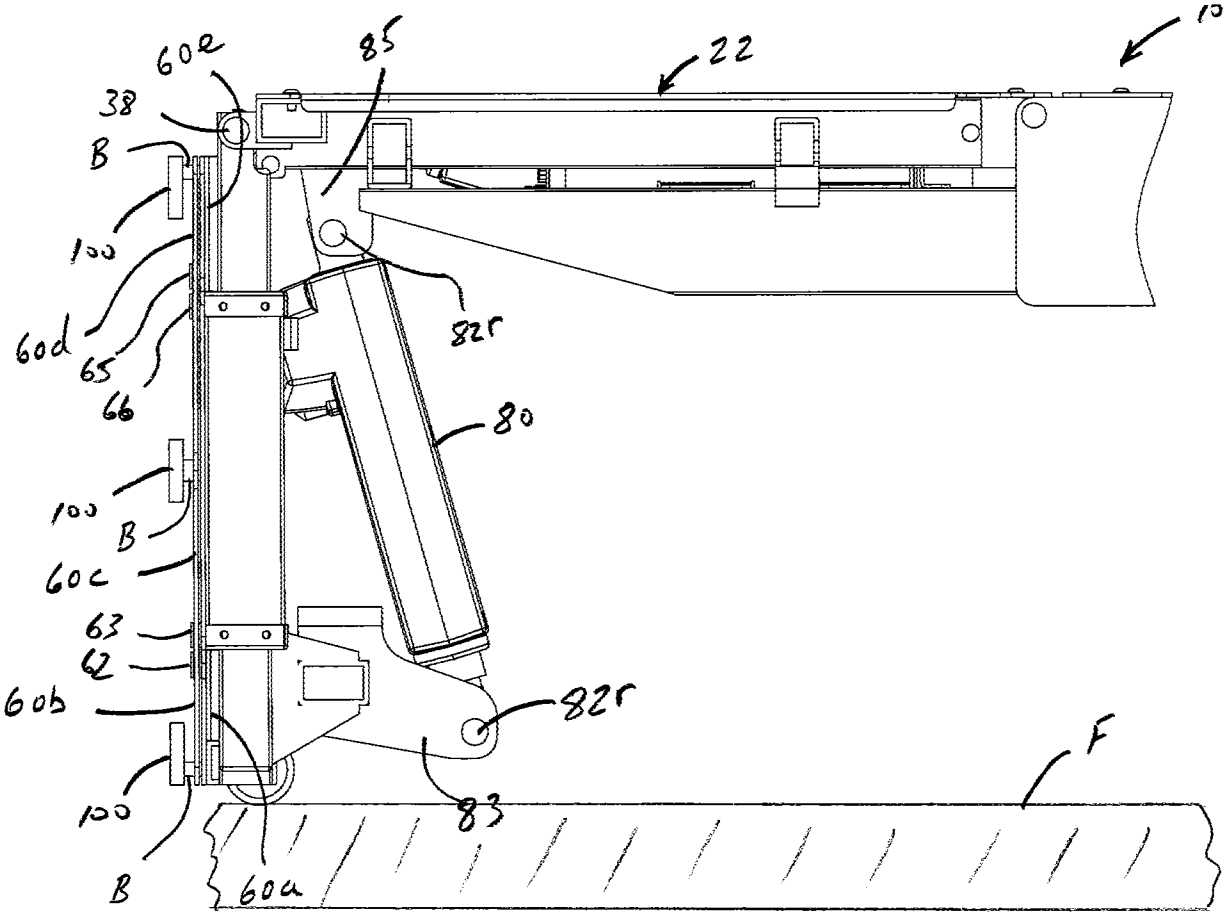
FIG. 4 is a partial side view of the hospital chair bed of FIG. 1 illustrating the hospital chair bed in a chair configuration with the foot section in a retracted configuration.

Referring to FIGS. 3-8, the frame assembly first section 74 of the illustrated foot section 24 includes at least one roller or wheel 78, shown as a plurality of spaced apart rollers/wheels, that are rotatably secured to the frame assembly first section 74. These wheels 78 are configured to contact a floor surface F and roll along the floor surface F as the foot section 24 is moved to the substantially orthogonal configuration relative to the seat section 22 via the actuator 80 in either a side egress or end egress configuration. The engagement of the wheels 78 with the floor surface F causes the frame assembly first and second sections 74, 76 to move to respective retracted positions, thereby causing the panels 60*a*-60*e* to move to the retracted configuration as illustrated in FIG. 4.

Alternatively, the articulated patient support surface 18 can be rotated in an elevated configuration to a side egress position with the foot section 24 in the extended configuration (FIG. 3). By lowering the patient support surface 18 via the lift mechanism 50, the foot section 24 contacts the floor surface and moves to a retracted configuration (FIG. 4).

In operation, the bed 10 can have the back section 20, seat section 22, and foot section 24 in a horizontal configuration, to support a patient in a supine position. To convert the bed 10 to a chair configuration, the back section 20, seat section 22 and foot section 24 articulate relative to each other as shown in FIG. 1, by actuators (e.g., pneumatic or hydraulic cylinders or other suitable electrical devices or electromechanical devices). For example, an actuator (not shown) can be utilized to pivot the back section 20 upwardly relative to the seat section 22. Another actuator 80 can be configured to pivot the foot section 24 relative to the seat section 22, as described above.

The transformation to a chair configuration can be carried out so that, the back section 20 and seat section 22 can be pivoted relative to each other (FIG. 1) and the foot section 24 and seat section 22 are at least somewhat pivoted relative to each other (FIG. 1). The articulated patient support surface 18 can be rotated approximately ninety degrees (90°) to permit side egress from the bed 10, as illustrated in FIG. 1.

Figure 10A:
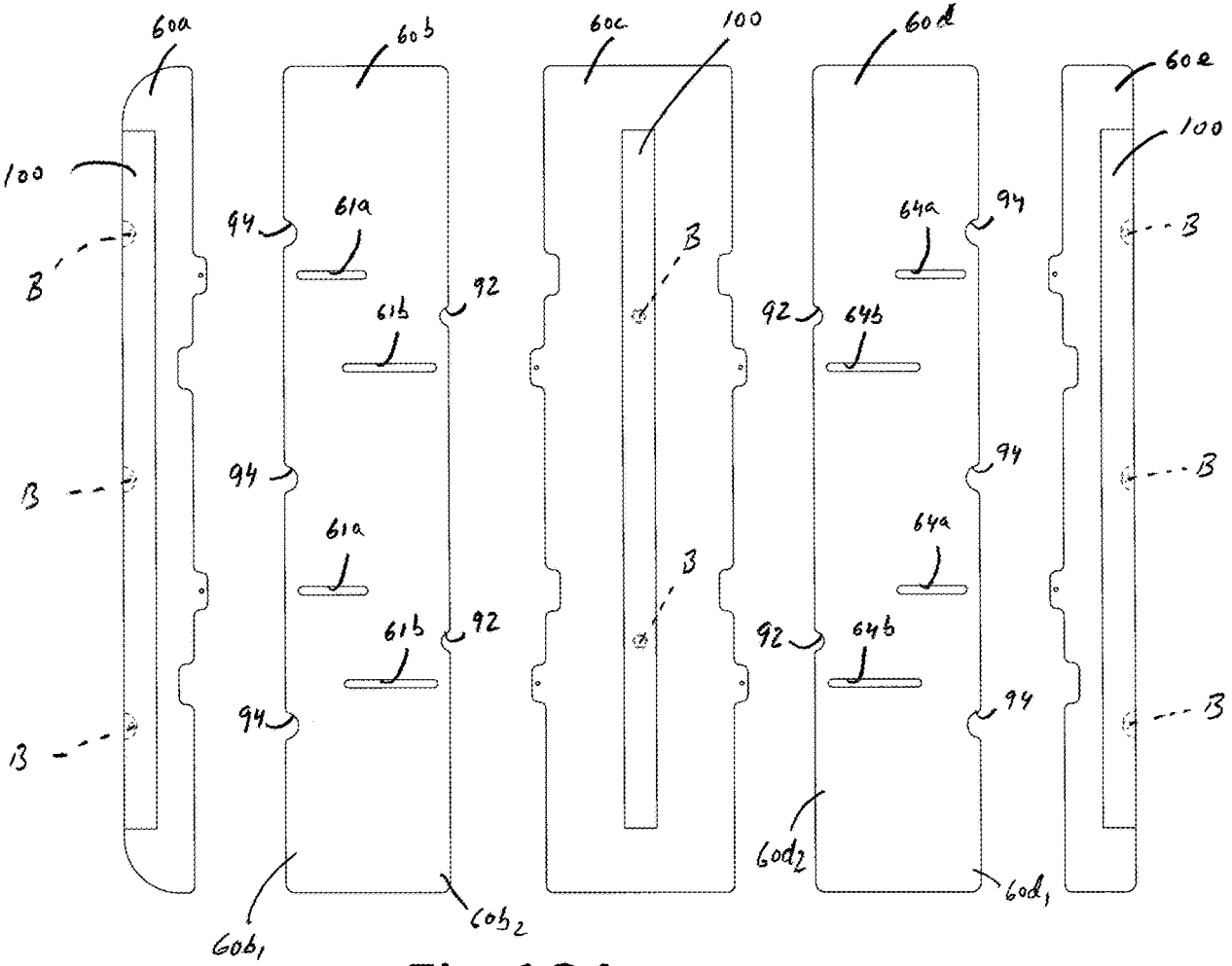
FIG. 10A is a top plan view of a foot section, according to some embodiments of the present invention, with the panels thereof in an extended configuration, and illustrating cutouts and apertures that facilitate movement of the panels between extended and retracted configurations with mattress support members secured thereto.
Figure 10B:
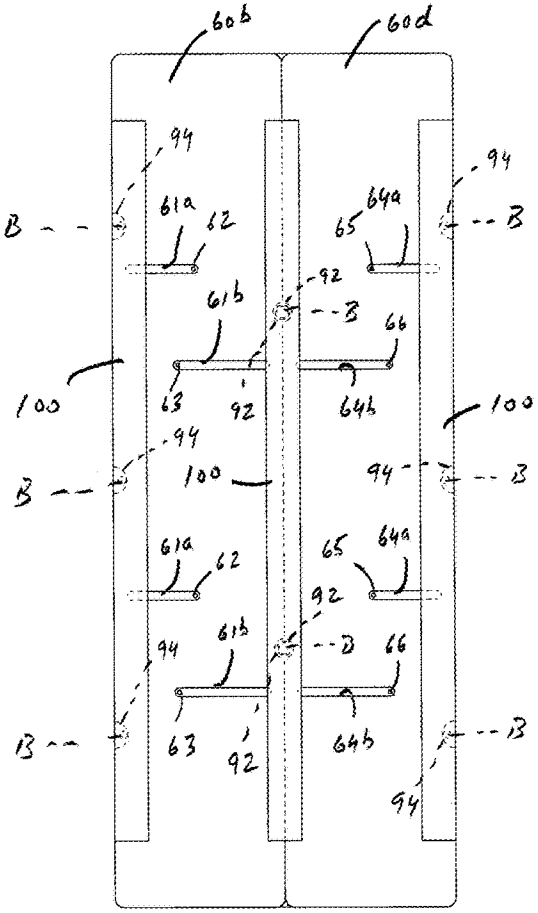
FIG. 10B illustrates the foot section of FIG. 10A with the panels in a retracted configuration.

Referring to FIGS. 10A-10B, a foot section 24 according to some embodiments of the present invention is illustrated. The illustrated foot section 24 includes a plurality of panels 60*a*, 60*b*, 60*c*, 60*d*, 60*e*, as described above. The panels 60*a*, 60*b*, 60*c*, 60*d*, 60*e* include apertures and cutouts that facilitate attachment of a mattress to the foot section 24. In the illustrated embodiment, panel 60*b* includes a plurality of spaced apart cutouts 94 along edge portion $\mathbf{60}b_1$, and a plurality of spaced apart cutouts 92 along edge portion $\mathbf{60}b_2$. Panel 60*d* includes a plurality of spaced apart cutouts 94 along edge portion $\mathbf{60}d_1$, and a plurality of spaced apart cutouts 92 along edge portion $\mathbf{60}d_2$.

The cutouts 94 of panel 60*b* are arranged such that, when panel 60*b* overlies panel 60*a* when the foot section 24 is in a retracted configuration, the cutouts 94 provide room for the mattress support member fasteners B, as illustrated in FIG. 10B. The cutouts 92 of panels 60*b* and 60*d* are arranged such that, when panels 60*b* and 60*d* overlie panel 60*c* when the foot section 24 is in a retracted configuration, cutouts 92 and apertures 90 in panel 60*c* align with each other (e.g., are stacked, one above or to the side of the other, etc.), as illustrated in FIG. 10B. The cutouts 94 of panel 60*d* are arranged such that, when panel 60*d* overlies panel 60*e* when the foot section 24 is in a retracted configuration, the cutouts 94 provide room for the mattress support member fasteners B, as illustrated in FIG. 10B.

In the illustrated embodiment, mattress support members 100 are secured to panels 60*a*, 60*c*, 60*e*, for example, via fasteners B such as bolts or screws, etc. The mattress support members 100 are shown in phantom line in FIGS. 10A-10B for ease of illustration. When the foot section 24 is moved to a retracted configuration, as illustrated in FIG. 10B, panels 60*b* and 60*d* move from the spaced apart configuration of FIG. 10A to the adjacent configuration of FIG. 10B so as to overlie panel 60*c*. The cutouts 92 in panels 60*b* and 60*d* align with each other so as not to interfere with the mattress support members 100. Similarly, panel 60*a* moves underneath panel 60*b* and panel 60*e* moves underneath panel 60*d* such that the cutouts 94 do not to interfere with the mattress support members B.

Figure 9:
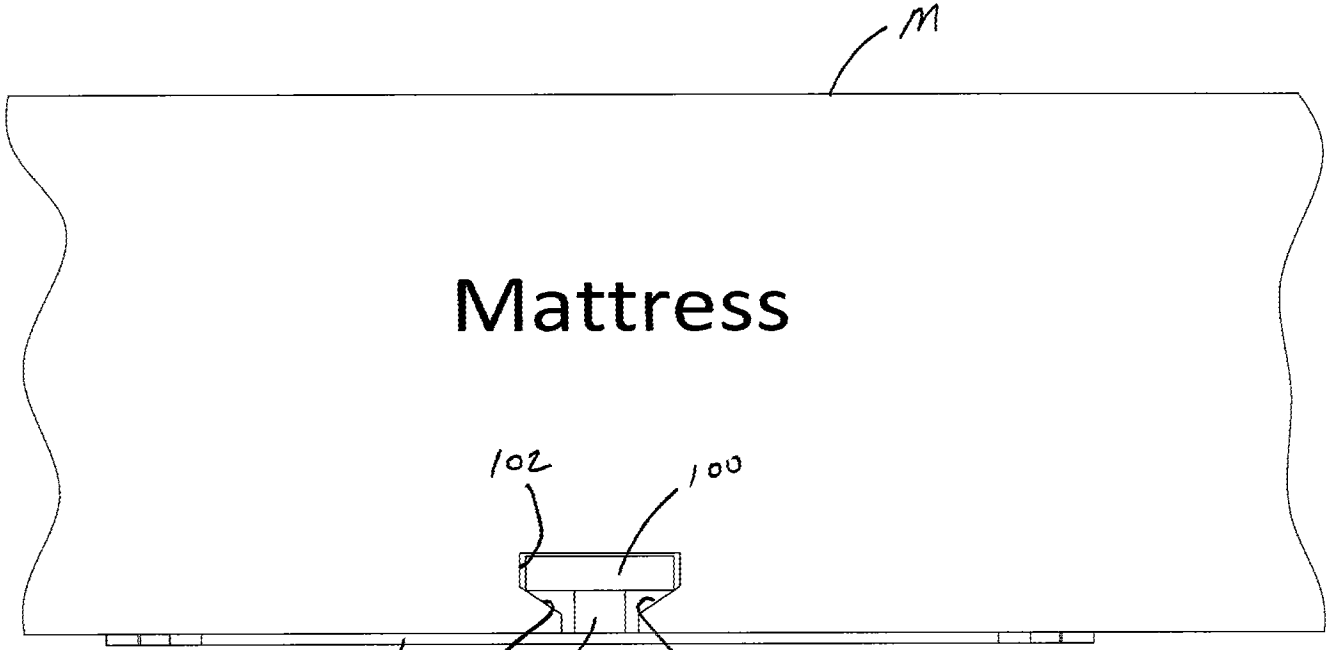
FIG. 9 is a side view of a foot section panel with one of the mattress support members illustrated in FIG. 1, according to some embodiments of the present invention and illustrating a mattress that is secured thereto.

Each mattress support member 100 can be configured to cooperate with an elongated clip 102 secured to or integral with a foot section of a mattress M, as illustrated in FIG. 9. (Only a single mattress support member 100 that is attached to panel 60*a* is shown in FIG. 9.) Each mattress support member 100 can be secured to a respective panel 60*a*, 60*c*, 60*e* in elevated, spaced apart relationship via fasteners B such that a respective elongated clip 102 can slidably engage a mattress support member 100. In the illustrated embodiment, each clip 102 has tapered sidewalls 102*a*, 102*b*. However, various configurations are possible. The illustrated configuration allows for easy attachment of a mattress M to the patient support surface 18 of the bed 10 (FIG. 1).

In the drawings and specification, there have been disclosed typical preferred embodiments of the invention and, although specific terms are employed, they are used in a generic and descriptive sense only and not for purposes of limitation, the scope of the invention being set forth in the following claims.

That which is claimed:

1. A hospital bed, comprising:

a base comprising opposite end portions;

a lifting mechanism secured to the base between the end portions; and a patient support surface pivotally secured to the lifting mechanism, wherein the patient support surface comprises a back section, a seat section, and a foot section configured to articulate relative to each other, and wherein the patient support surface is configured to translate from a bed configuration to a chair configuration;

wherein the foot section comprises first, second, third, fourth, and fifth panels operably connected together that are configured to move relative to each other in substantially parallel overlapping planes between an extended configuration when the patient support surface is in a bed configuration and a retracted configuration when the patient support surface is in a chair configuration, wherein the first, third and fifth panels move relative to each other in a first plane, and wherein the second and fourth panels move relative to each other in a second plane.

2. The hospital bed of claim 1, wherein a free end of the foot section is configured to contact a floor surface when the patient support surface is in a chair configuration, and wherein contact with the floor surface forces the plurality of panels to move to the retracted configuration.

3. The hospital bed of claim 2, wherein the foot section comprises at least one biasing member configured to urge the plurality of panels to the extended configuration.

4. The hospital bed of claim 1, wherein the foot section further comprises a frame assembly, the frame assembly comprising:

a foot section base having opposite first and second sides;

a first section telescopically secured to the foot section base first side and movable relative to the foot section base between retracted and extended positions; and a second section telescopically secured to the foot section base second side and movable relative to the foot section base between retracted and extended positions.

5. The hospital bed of claim 4, wherein the foot section base comprises at least one biasing member configured to urge the first and second sections outwardly from the base to respective extended positions.

6. The hospital bed of claim 4, wherein the first and second sections each comprise a plurality of spaced-apart elongated legs telescopically secured to the base, wherein the base comprises a respective plurality of biasing members associated with the first section legs that are configured to urge the first section outwardly from the base to a respective extended position, and wherein the base comprises a respective plurality of biasing members associated with the second section legs that are configured to urge the second section outwardly from the base to a respective extended position.

7. The hospital bed of claim 4, wherein the first panel is secured to the first section, the third panel is secured to the base, and the fifth panel is secured to the second section.

8. The hospital bed of claim 7, wherein the second panel is slidably secured to the first and third panels, and the fourth panel is slidably secured to the third and fifth panels.

9. The hospital bed of claim 4, wherein the second section of the frame assembly is pivotally secured to the seat section.

10. The hospital bed of claim 4, further comprising an actuator configured to move the foot section between a substantially co-planar configuration relative to the seat section and a substantially orthogonal configuration relative to the seat section.

11. The hospital bed of claim 10, wherein the frame assembly first section is configured to contact a floor surface when the foot section is moved to the substantially orthogonal configuration relative to the seat section, and wherein contact with the floor surface causes the frame assembly first and second sections to move to respective retracted positions.

12. The hospital bed of claim 11, wherein the frame assembly first section comprises at least one roller or wheel configured to contact the floor surface and roll along the floor surface as the foot section is moved to the substantially orthogonal configuration relative to the seat section.

13. The hospital bed of claim 1, wherein the lifting mechanism is configured to raise and lower the patient support surface relative to the base, and further comprising a rotating frame mounted on the lifting mechanism, wherein the rotating frame is configured to rotate horizontally relative to the base, wherein the patient support surface is pivotally secured to the rotating frame, and wherein the patient support surface is configured to translate from a bed configuration to a side-egress chair configuration.

14. A method of translating a hospital bed to an egress configuration, wherein the bed comprises a base having opposite end portions, a lifting mechanism secured to the base between the end portions, and a patient support surface pivotally secured to the lifting mechanism, the method comprising:

articulating back, seat and foot sections of the patient support surface relative to each other from a substantially co-planar configuration to a chair configuration, wherein the foot section includes a plurality of panels that are configured to move relative to each other in substantially parallel overlapping planes between an extended configuration when the patient support surface is in a bed configuration and a retracted configuration when the patient support surface is in a chair configuration, wherein the foot section comprises first, second, third, fourth, and fifth panels operably connected together; and contacting a floor surface with the foot section such that the first, third and fifth panels move relative to each other in a first plane, and such that the second and fourth panels move relative to each other in a second plane parallel to and over or under the first plane; and forcing the plurality of panels to move to the retracted configuration in response to the floor contact.

15. The method of claim 14, further comprising rotating the back, seat and foot sections 90 degrees to a side egress position prior to the contacting step.

* * * * *